United States Patent [19]

Christopher

[11] Patent Number: 4,474,263

[45] Date of Patent: Oct. 2, 1984

[54] DERRICK ELEVATOR

[76] Inventor: Gordon W. Christopher, P.O. Box 826, Odessa, Tex. 79760

[21] Appl. No.: 447,245

[22] Filed: Dec. 6, 1982

[51] Int. Cl.[3] ..... A62B 1/02

[52] U.S. Cl. ..... 182/10; 182/142; 187/6

[58] Field of Search ..... 182/10, 142, 143, 144, 182/191, 192, 193; 187/6, 20

[56] References Cited

U.S. PATENT DOCUMENTS

| | | | |
|---|---|---|---|
| 1,849,725 | 3/1932 | Quick | 182/10 |
| 2,670,890 | 3/1954 | Hodge | 182/10 |
| 2,948,348 | 8/1960 | Bott | 182/11 |
| 3,262,518 | 7/1966 | Webb | 182/191 |
| 3,826,335 | 7/1974 | Allen | 182/10 |
| 4,037,684 | 7/1977 | Moyer | 182/2 |
| 4,056,167 | 11/1977 | Bonafos | 182/10 |
| 4,111,281 | 9/1978 | Jacobs | 182/10 |
| 4,226,300 | 10/1980 | Rallis | 182/2 |
| 4,294,331 | 10/1981 | Reynoir | 182/10 |

*Primary Examiner*—Reinaldo P. Machado
*Attorney, Agent, or Firm*—James E. Bradley

[57] ABSTRACT

A system for moving personnel between two elevations has features that allow control of ascent and descent by the passenger. The system has a cage carried by a load bearing cable that is moved to raise and lower the cage. The cable also has a plurality of electrical conductors within it that are insulated from each other. Passenger controls are connected to the electrical conductors of the cable. The conductors are connected at the other end to the powered lifting device, preferably through a slip ring assembly.

8 Claims, 6 Drawing Figures

DERRICK ELEVATOR

BACKGROUND OF THE INVENTION

In oil and gas drilling rigs and in workover units, there is frequently a need for a man to work in the derrick. In large drilling rigs, often the derrick man will be working at least 90 foot above the rig floor. In case the well blows out or the rig catches on fire, the derrick man would be trapped unless some means is provided for him to safely reach the ground. Climbing down the derrick itself would not be possible ordinarily in case of a fire or blow out.

Drilling rigs have long used safety lines for the derrick man. The safety line, or "Geronimo" line, inclines from a point in the derrick near the derrick man's station, or "monkey board", to a point on the ground some distance away. There are various types of slings with hand brakes with which the derrick man can slide down the line. However, many of these hand brakes and slings are difficult to operate and dangerous. The derrick man is likely to injure himself, even if the sling and brake had been properly maintained, which is often not the case.

In addition to emergencies, it is not infrequent for injuries to occur as a result of the derrick man climbing to and from the monkey board. Normally, the only means by which the derrick man can reach the monkey board and return to the derrick floor is by an uncaged ladder. This is particularly dangerous during wet or icy weather, and because of water and drilling mud often lying on the rig floor. Various patents exist that disclose proposals to remedy some of the problems, however these have not been widely adopted.

SUMMARY OF THE INVENTION

A system is provided for moving personnel between two elevations, particularly between the ground or a deck of an offshore drilling rig and the monkey board in a derrick. The system includes a cage for carrying at least one person. A power lifting means, such as a winch is preferably located on the ground and connected to the cage through a cable. The cable is of a type that has a plurality of electrical conductors that are insulated from each other. The cage has a passenger control which is connected to the conductors of the cable. The conductors are connected through a slip ring assembly to the power lifting means. This enables the passenger to control the winch from the cage for moving to and from a point in the derrick.

DESCRIPTION OF THE PREFERRED EMBODIMENT

Figures 1, 2, 3:
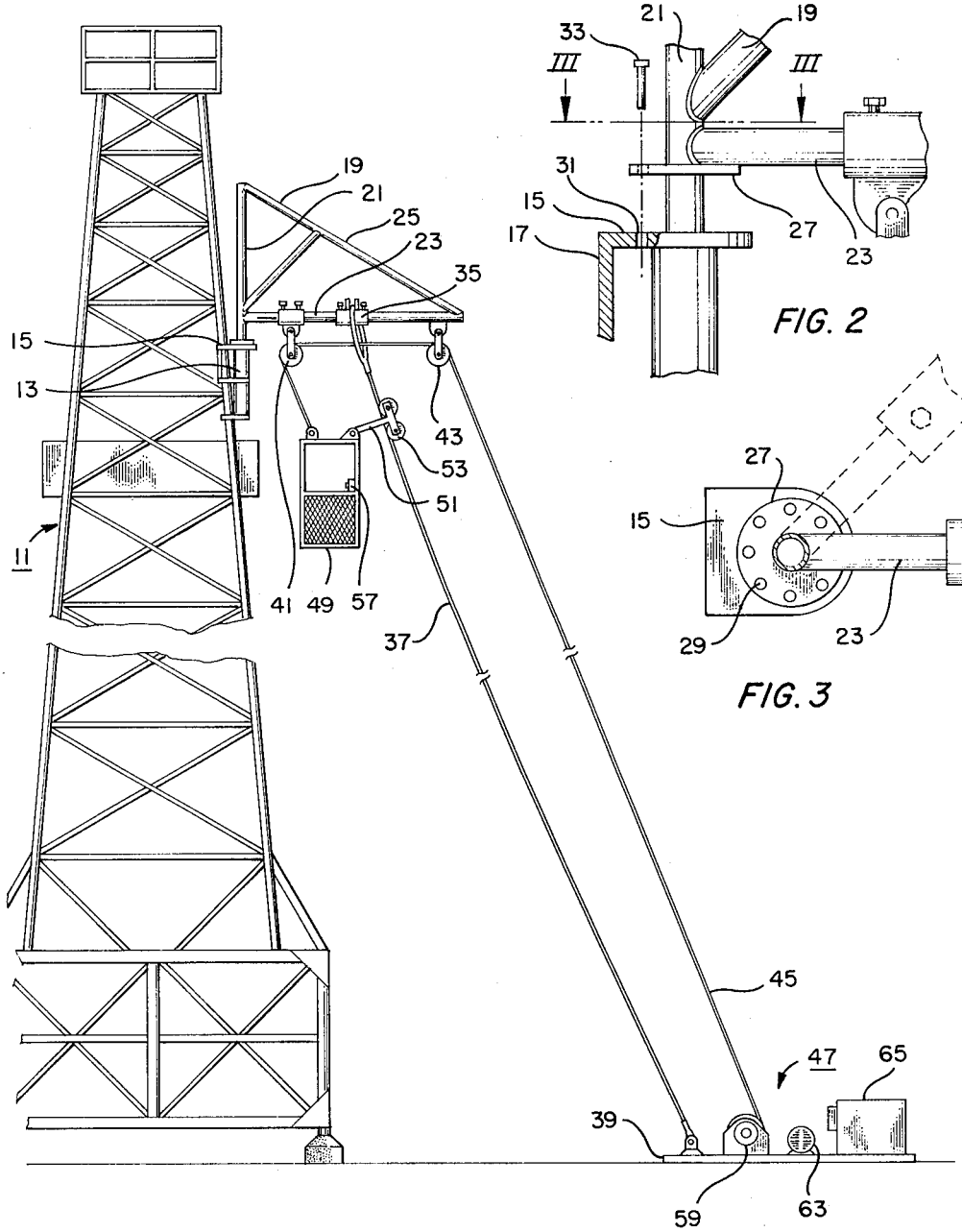
FIG. 1 is a side view, schematically illustrating a system constructed in accordance with this invention.
FIG. 2 is an enlarged, exploded illustration of a portion of the gantry of the system shown in FIG. 1.
FIG. 3 is a sectional view of the gantry portion shown in FIG. 2, taken along the line III—III.

Referring to FIG. 1, derrick 11 is a conventional type. Once the well is completed, the derrick will be partially dismantled, collapsed and carried to a new drilling site. The derrick elevator includes a sleeve 13 that is adapted to be secured permanently to a leg of derrick 11. Sleeve 13 has a cylindrical bore and a number of flanges 15 that extend laterally to a plate 17. (FIG. 2). Plate 17 bolts to a leg of derrick 11 and inclines slightly with respect to the axis of sleeve 13 corresponding to the inclination of the leg of derrick 11. This inclination, normally about 2°, places the axis of sleeve 13 in a vertical position.

A gantry 19 is removably carried by sleeve 13 so that it can be removed when the derrick 11 is being transported to a new site. Gantry 19 has an upright member 21 that is closely and telescopingly received within sleeve 13, as shown in FIG. 2. A lateral or horizontal member 23 extends at a right angle from upright member 21. A cross brace 25 connects the ends of the upright member 21 and the horizontal member 23, to provide a triangular configuration for gantry 19. A flange 27 encircles upright member 21 immediately below horizontal member 23. Flange 27 is larger in diameter than the bore of sleeve 13, and rests on flange 15 to support gantry 19. Flange 27 has a plurality of holes 29, shown in FIG. 3, that will register with a hole 31 located in flange 15 as the gantry 19 is rotated to various positions. A pin 33 is adapted to be inserted through a hole 29 and hole 31 to lock the gantry 19 against rotation. The holes 29 and 31 and pin 33 serve as locking means to enable gantry 19 to be oriented in various radial positions with respect to sleeve 13, as indicated by the dotted lines in FIG. 3.

A collar 35 is secured to horizontal member 23 by bolts which enable collar 35 to be positioned at various points along horizontal member 23. A carrying or dead line 37 loops over collar 35 and is secured to a skid 39 which rests on the ground or is part of the deck on an offshore rig. Skid 39 will be located at a considerable distance from derrick 11, preferably placing the inclination of dead line 37 at 45°. Horizontal member 23 also supports a sheave 41 that is mounted on a collar so that it may be located at various points along horizontal member 23. Sheave 41 is located between collar 35 and upright member 21. A sheave 43 is located on the other side of collar 35 near the free end of horizontal member 23. A cable 45 is reeved through sheaves 41 and 43 and wrapped around a winch 47 mounted to skid 39. The other end of cable 45 is connected to a cage 49 which is large enough to carry at least one person.

Cage 49 is an open, metal rectangular structure, with doors (not shown) for allowing personnel to enter. Cage 49 has a pivotal arm 51 that extends upwardly and forwardly from its top. Rollers 53 are mounted to the end of arm 51, the rollers engaging the dead line 37. A hand brake (not shown) of a conventional nature allows the passenger to lock the rollers to dead line 37, to stop the downward movement of cage 49 should a malfunction occur. A set of controls 57 include switches for upward and downward movement, and are located in cage 49 for use by the passenger.

Controls 57 control the movement of winch 47. Winch 47 is preferably hydraulically driven, with a hydraulic motor 59 for causing upward and downward movement of cable 45. Hydraulic motor 59 is driven by pump 61 (FIG. 6), which is in turn driven by an electric motor 63. Skid 39 contains a duplicate set of controls to enable control of the cage 49 from the surface. Skid 39 also contains a reservoir 65 for holding hydraulic fluid for motor 59.

Figure 4:
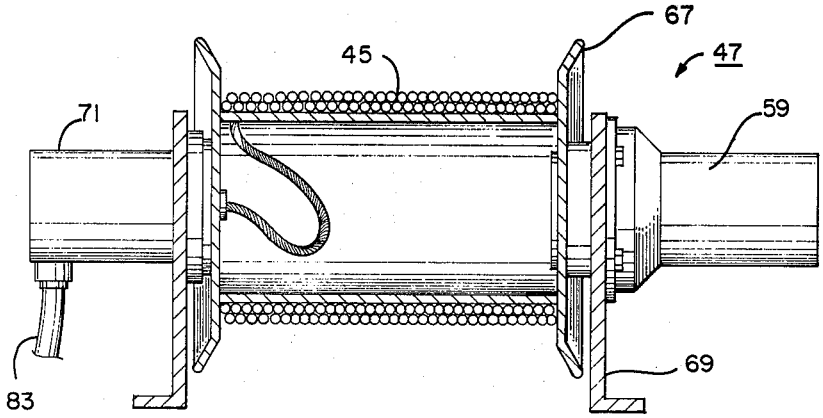
FIG. 4 is a schematic, partially sectional view of a winch for the system of FIG. 1.
Figure 5:
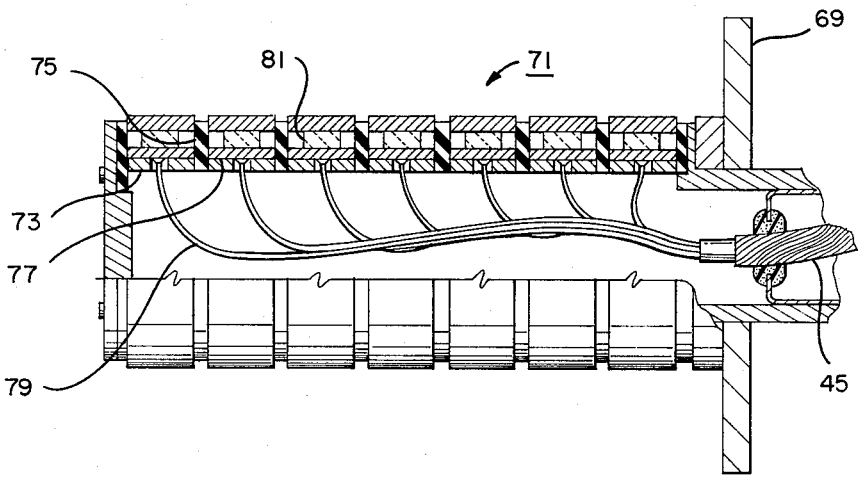
FIG. 5 is an enlarged, sectioned view schematically illustrating a slip ring assembly for the winch of FIG. 4.

Referring to FIG. 4, winch 47 includes a drum 67 about which cable 45 is wrapped. Drum 67 is rotatably mounted on supports 69 and driven by hydraulic motor 59. On the opposite side, slip ring assembly 71 enables controls 57 (FIG. 1) to control the winch 47. Slip ring assembly 71 is a conventional type such as used in well logging. FIG. 5 illustrates schematically the major components of slip ring assembly 71.

Included with the slip ring assembly 71 is a core 73 of support rings secured together on a common axis, which is also the axis of rotation of drum 67. A plurality of electrically conductive rings 77 are mounted to the support rings of core 73, each also concentric with the axis of drum 67. Rings 77 are separated by electrical insulators 75. The cable 45 has a number of conductors 79, each insulated from the other conductors 79. Each of these conductors is connected to one of the rings 77. The core 73 and rings 77 will rotate in unison with drum 67. A stationary brush 81 slidingly engages each ring 79. Brush 81 is of a conductive material for transmitting the electrical signal from conductor 79 to brush 81. The brushes 81 are connected to a plurality of leads 83 (FIG. 4) that lead to the controls for the winch 47. Brushes 81 remain stationary with the supports 69 as the drum 67 rotates.

Figure 6:
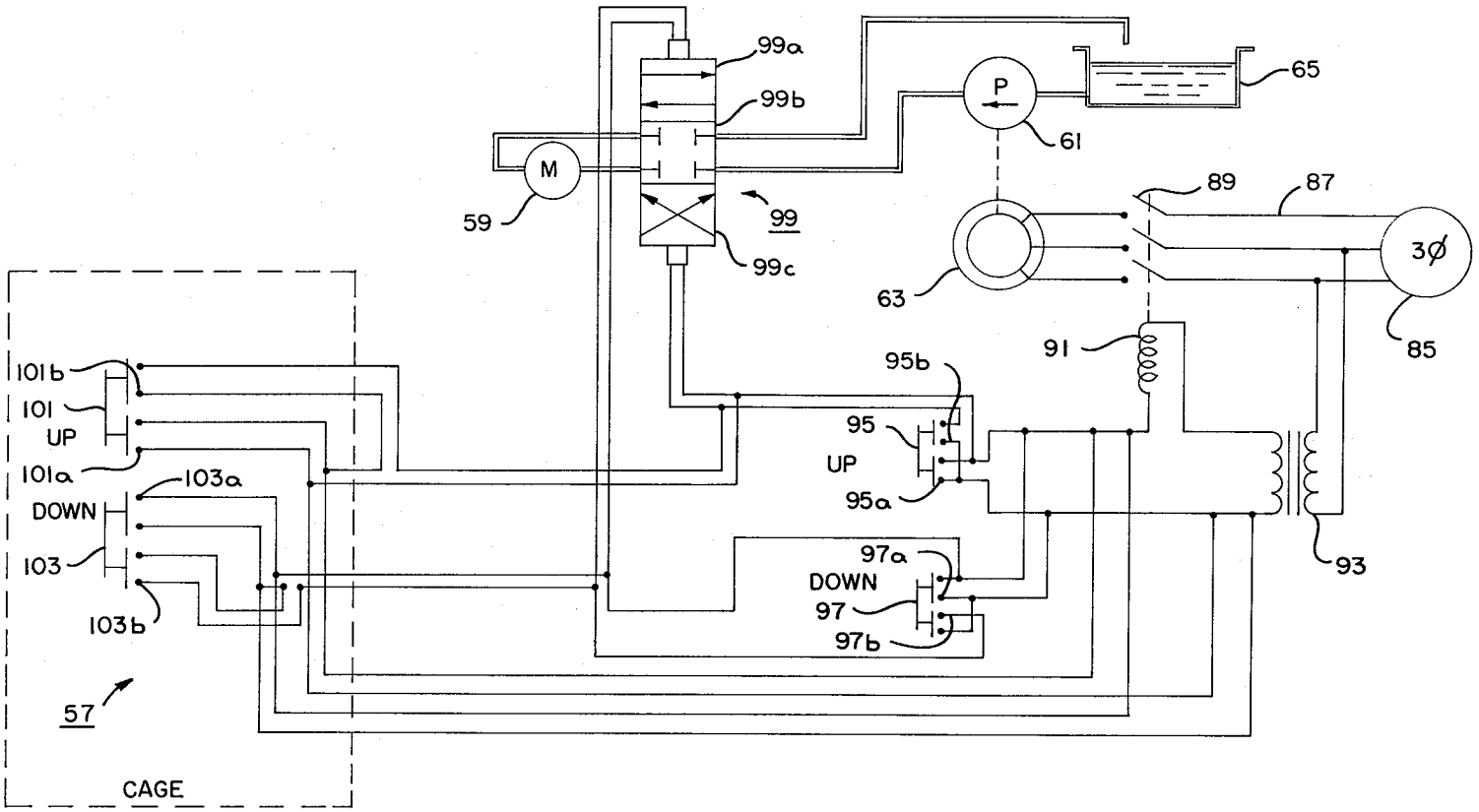
FIG. 6 is a simplified electrical and hydraulic schematic for the system of FIG. 1.

Referring to FIG. 6, a simplified hydraulic and electrical schematic is shown to illustrate the controls for the winch 47. A power source 85, normally the generator for the rig, generates three phase power on lines 87 that lead to electric motor 63, which is preferably a three-phase motor. If desired, a step down transformer could be placed between the power source 85 and the motor 63. Relay switches 89 selectively engage the motor 63 with the power source 87. Relay switches 89 are driven by a relay coil 91. Relay coil 91 is powered by 110 volt two phase power from a transformer 93, which is tapped onto two of the lines 87 from the power supply 85.

A stationary up switch 95 has two terminals **95*a* that are closed to energize coil 91 when switch 95 is depressed. Up switch 95 is mounted on skid 39. In addition, a stationary down switch 97 has two terminals 97*a* that are closed when switch 97 is depressed to energize coil 91. Depressing either up switch 95 or down switch 97 actuates motor 63** to turn in a single direction.

At the same time, a directional valve 99 is actuated to control the direction of hydraulic motor 59. Directional valve 99 has a neutral position **99*b* in which flow from pump 61 and to reservoir 65 is blocked. In position 99*c*, fluid flows to motor 59 from pump 61 and returns to reservoir 65. In position 99*c*, the motor 59 rotates drum 67 (FIG. 4) in an upward direction to pull up cage 49 (FIG. 1). In position 99*b*, fluid is directed to the opposite side of motor 59 from pump 61, to cause drum 67 to rotate in a reverse or down direction for lowering cage 49**.

Directional valve 99 has two solenoids to electrically shift the valve from position **99*b* to position 99*c* or 99*a*. The solenoid for position 99*c* has one lead connected to relay coil 91 and another lead connected to terminals 95*b* of up switch 95. When up switch 95 is depressed, terminals 95*b* will be closed to supply electrical energy to the solenoid of position 99*c* for rotating the drum 67 in the upward direction. Similarly, position 99*a* has a solenoid with one lead connected to relay coil 91 and another lead connected to a terminal 97*b* of switch 97. When switch 97 is depressed, terminal 97*b* completes the circuit to energize directional valve 99 to shift to the downward position 99*a***.

A passenger up switch 101 is connected in parallel with stationary up switch 95 for controlling pump 63 and directional valve 99. The passenger up switch is located with controls 57 in cage 49 (FIG. 1) and is connected to upper ends of certain of the conductors 79 (FIG. 5). These conductors are connected through slip ring assembly 71 to leads 83, which in turn are connected to the stationary switch 95. Passenger up switch 101 has terminals 101 that are connected across relay 91 for energizing relay 91 when terminal **101*a* is closed. Passenger up switch 101 has terminals 101*b* that are connected to the solenoid of position 99*c* of directional valve 99. Depressing switch 101 closes terminals 101*b* to shift directional valve 99** to the up direction.

A passenger down switch 103 is connected in parallel with stationary down switch 97 for controlling downward movement of cage 49 (FIG. 1) from the controls 57 in the cage. Down switch 103 has terminals **103*a* that are connected across relay coil 91 to close the circuit to relay coil 91 when down switch 103 is depressed. Terminals 103*b* are connected to the solenoid of position 99*a* of directional valve 99 to shift the valve to the downward position when terminals 103*b*** are closed.

Referring to FIG. 1, in operation, sleeve 13 will remain with derrick 11 as it is transported. Once derrick 11 is erected, gantry 19 will be inserted into sleeve 13. As shown in FIG. 2, pin 33 will be inserted to lock the gantry 19 against rotation at the desired orientation with respect to derrick 11. Sheaves 41 and 43 will be connected and cable 45 reeved through these sheaves. Dead line 37 will be secured to collar 35. Skid 39 is positioned so as to provide the proper inclination and tautness of dead line 37.

To raise the cage 47, the passenger steps inside then actuates the passenger up switch 101, shown in FIG. 6. This completes the circuit through relay coil 91 to energize electric motor 63. Electric motor 63 drives pump 61. At the same time, terminals **101*b* are closed to shift directional valve 99 to position 99*c* to drive hydraulic motor 59. Hydraulic motor 59 rotates drum 67 while the up switch 101 is depressed. As the drum rotates, the electrical circuit through the up switch 101 is completed through the slip ring assembly 71 as shown in FIG. 5. Two of the conductors 79 will be receiving power from brushes 81, which in turn are connected to leads which extend to the relay coil 91 and directional valve 99**.

When the cage 49 reaches the desired elevation, the user releases pressure on the up switch 101. This cuts the power to electric motor 63 and places directional valve 99 in the neutral position, blocking flow in any direction. Should the operator fail to release the up switch 101 at the proper elevation, the cage 49 will contact a stop plate (not shown) about four or five feet higher. A hydraulic pressure relief valve (not shown) causes winch 47 to stop rotating drum 67 to prevent cable 45 from parting even though motor 63 and pump 61 are still running.

To lower cage 49, the procedure is repeated with the operator pushing the down switch 103, shown in FIG. 6. This energizes relay 91 to turn on electric motor 63, and also energizes the solenoid of position **99*a* of directional valve 99. Pump 61 will supply fluid to motor 63 in a reverse direction to play out cable 45 and lower the cage 49. No frictional braking is required during lowering, either with drum 67 or dead line 37, since the weight of cage 49 will not overrun the hydraulic motor 59. Once at the skid 39, the passenger releases the down switch 103 to turn off motor 63 and place directional valve 99 in the neutral position. Cage 49 can be raised and lowered by using the stationary switches 95 and 97 at skid 39** in the same manner.

The invention has significant advantages. The cage is a much improved means for transporting the derrick man from the derrick to safety should a fire or blow out occur. Since the cage does not rely on frictional braking, no skill is required to assure a safe descent speed. The hydraulic motor 57 will provide the same descent speed independent of normal loads. In addition, the derrick elevator can be used on a regular basis for moving to and from the monkey board in a much safer manner than climbing a ladder. Use of the conductors in a cable which also bears the weight of the cage enables electrical controls to be placed in the cage for passenger control. This avoids the need for having an operator at the surface each time the derrick man wants to ascend and descend.

While the invention has been shown in only one of its forms, it should be apparent to those skilled in the art that it is not so limited but is suseptable to various changes without departing from the scope of the invention.

I claim:

1. A system for moving personnel between two elevations comprising:

cage means for carrying at least one passenger;

powered lifting means, having a load bearing cable secured to and supporting the weight of the cage means, for moving the cable to raise and lower the cage means;

the cable having a plurality of electrical conductors insulated from each other; and passenger control means mounted in the cage means for control by the passenger to selectively actuate the lifting means to raise and lower the cage means, the control means being electrically connected to the lifting means through the electrical conductors of the cable.

2. The system according to claim 1 further comprising:

a stationary control means mounted stationarily to the lifting means and electrically connected in parallel with the passenger control means, for raising and lowering the cage means.

3. A system for moving personnel between two elevations, comprising:

cage means for carrying at least one passenger;

winch means mounted at one of the elevations for raising and lowering the cage means, the winch means having a drum wrapped with cable that extends to the cage means, and having power means for rotating the drum;

the cable having a plurality of electrical conductors insulated from each other;

slip ring means mounted to the drum for transferring electrical continuity from the conductors to stationary leads extending to the power means; and passenger control means mounted in the cage means for control by the passenger to selectively actuate the power means to rotate the drum for raising and lowering the cage means, the passenger control means being electrically connected to the power means through the electrical conductors and slip ring means.

4. A system for moving personnel between higher and lower elevations, comprising:

a dead line inclined from and anchored between the higher and lower elevations;

cage means for traversing the dead line to transport at least one passenger;

winch means mounted at the lower elevation for raising and lowering the cage means along the dead line, the winch means having a drum wrapped with cable that extends over a sheave at the higher elevation and is secured to the cage means;

the winch means also having power means for rotating the drum that includes a hydraulic motor which rotates the drum in upward and downward directions in response to hydraulic fluid pressure supplied through directional control valve means by a hydraulic pump driven by an electric motor, the directional control valve means controlling the direction of flow of the hydraulic fluid to the hydraulic motor for upward and downward directions;

a cable having a plurality of electrical conductors insulated from each other;

a plurality of slip rings mounted to the drum for rotation therewith, electrically insulated from each other and connected to the conductors;

a plurality of brushes mounted to the winch means, each in sliding electrical contact with one of the slip rings, the electric motor having actuating switch means electrically connected to at least one of the brushes, the directional valve also being electrically connected to the brushes; and passenger control means mounted in the cage means for actuation by the passenger to selectively raise and lower the cage means, the control means being electrically connected to the upper ends of the conductors, thereby controlling the electric motor and the directional control valve means through the electrical conductors, slip rings and brushes.

5. The system according to claim 4 wherein the directional control valve means is a normally closed valve that blocks hydraulic fluid flow to and from the hydraulic motor unless electrically opened selectively to one of an upward and downward position.

6. The system according to claim 4 further comprising:

stationary control means mounted stationarily at the lower elevation and electrically connected in parallel with the passenger control means, for raising and lowering the cage means independently of the passenger control means.

7. The system according to claim 4 further comprising, mounting means for mounting the upper end of the dead line and the sheave to a derrick, the mounting means comprising:

a sleeve adapted to be secured upright to the derrick;

a gantry having an upright member that telescopingly slides within the sleeve and a lateral member extending laterally outward from the upright member, the lateral member carrying the sheave and upper end of the dead line.

8. The system according to claim 7 wherein the upright member is selectively rotatable with respect to the sleeve, the system further comprising:

locking means for securing the gantry to the sleeve at selected radial positions with respect to the axis of the sleeve.

* * * * *